US011959697B2

(12) United States Patent
Deshpande et al.

(10) Patent No.: US 11,959,697 B2
(45) Date of Patent: Apr. 16, 2024

(54) BEVERAGE CHILLER

(71) Applicant: PepsiCo, Inc., Purchase, NY (US)

(72) Inventors: Prashant Deshpande, Gurgaon (IN); Gurmeet Bhutani, Haryana (IN); Brian Kelly, Scotch Plains, NJ (US); Wilton Brown, White Plains, NY (US)

(73) Assignee: PepsiCo, Inc., Purchase, NY (US)

( * ) Notice: Subject to any disclaimer, the term of this patent is extended or adjusted under 35 U.S.C. 154(b) by 0 days.

(21) Appl. No.: 18/053,675

(22) Filed: Nov. 8, 2022

(65) Prior Publication Data

US 2023/0077646 A1 Mar. 16, 2023

Related U.S. Application Data

(62) Division of application No. 16/598,695, filed on Oct. 10, 2019, now Pat. No. 11,519,654.

(30) Foreign Application Priority Data

Oct. 11, 2018 (IN) ..... 201841038633

(51) Int. Cl.
*F25D 3/00* (2006.01)

(52) U.S. Cl.
CPC ..... *F25D 3/00* (2013.01); *F25D 2331/80* (2013.01); *F25D 2400/28* (2013.01)

(58) Field of Classification Search
CPC . F25D 3/00; F25D 3/02; F25D 31/002; F25D 31/003; F25D 31/007; F25D 2331/80; F25D 2331/805; F25D 2400/28
See application file for complete search history.

(56) References Cited

U.S. PATENT DOCUMENTS

| | | | | |
|---|---|---|---|---|
| 6,314,751 | B1 * | 11/2001 | Gjersvik | F25D 31/007 62/372 |
| 8,177,418 | B2 | 5/2012 | Edwards et al. | |
| 8,516,849 | B2 | 8/2013 | Mooijer et al. | |
| 10,190,818 | B2 | 1/2019 | Parker et al. | |
| 2004/0112069 | A1 | 6/2004 | Loibl et al. | |
| 2008/0134695 | A1 | 6/2008 | Loibl et al. | |
| 2013/0291570 | A1 | 11/2013 | Dahokey et al. | |

(Continued)

FOREIGN PATENT DOCUMENTS

| | | | |
|---|---|---|---|
| CA | 2976762 | A1 | 2/2018 |
| FR | 2153144 | A2 | 5/1973 |

(Continued)

OTHER PUBLICATIONS

International Search Report and Written Opinion issued in International Application No. PCT/US19/57138, dated Dec. 23, 2019, 11 pages.

*Primary Examiner* — Joseph F Trpisovsky
(74) *Attorney, Agent, or Firm* — Sterne, Kessler, Goldstein & Fox P.L.L.C.

(57) ABSTRACT

Beverage chillers are disclosed. A beverage chiller may include a container platform that receives a beverage container and a chiller tank. The chiller tank may have a central axis and may have an agitator. The chiller tank may be filled with water. A conveyor may move the container platform and beverage container into the chiller tank. The container platform and beverage container may rotate in a first direction in the chiller tank and the agitator may rotate the water in a second direction.

20 Claims, 8 Drawing Sheets

(56) References Cited

U.S. PATENT DOCUMENTS

| | | | | |
|---|---|---|---|---|
| 2014/0083051 | A1 | 3/2014 | Mielnik et al. | |
| 2015/0233631 | A1 * | 8/2015 | Shuntich | F25D 3/08 62/64 |
| 2018/0120023 | A1 | 5/2018 | Shuntich | |
| 2019/0331392 | A1 | 10/2019 | LoVerde et al. | |

FOREIGN PATENT DOCUMENTS

| | | | | |
|---|---|---|---|---|
| JP | 2009293852 | A | 12/2009 | |
| WO | WO-2009072876 | A1 * | 6/2009 | F25D 16/00 |

* cited by examiner

BEVERAGE CHILLER

CROSS-REFERENCE TO RELATED APPLICATIONS AND INCORPORATION BY REFERENCE

The present application is a divisional of U.S. application Ser. No. 16/598,695, filed Oct. 10, 2019, which claims benefit of and priority to Indian Patent Application No. 201841038633, filed on Oct. 11, 2018, both of which are incorporated herein by reference in their entireties.

FIELD

The described embodiments generally relate to beverage chillers. Specifically, some described embodiments relate to rapid beverage chillers and related methods.

BACKGROUND

Beverage chillers may be used to cool beverages on-demand. While conventional coolers, such as refrigerators, may keep multiple beverages cool for long periods of time, beverage chillers may cool a limited number of beverage at a time. For example, a customer may select a beverage that is at room temperature and place the beverage container in a beverage chiller. Conventional beverage chillers may include cold water baths. A customer may place the beverage container in the cold water bath and wait for the temperature of the beverage to drop. This may take over 10 minutes for some beverage containers. Other conventional beverage containers may rotate the beverage container about the beverage container's vertical axis. All or a portion of the beverage container may be in contact with the cold water bath during rotation. However, this process may still take over 5 minutes to cool some beverage containers.

Therefore, a continuing need exits for methods and systems to automatically chill a beverage container rapidly.

SUMMARY

According to some embodiments, a beverage chiller includes a container platform, a chiller tank, and a container conveyor. The container platform is configured to receive a beverage container containing a beverage. The chiller tank may have an axis and include a water bath and an agitator. The axis of the chiller tank may be a central axis located approximately in the center of the chiller tank. The container conveyor may move the container platform with a beverage container from an intake area into the chiller tank. Inside the chiller tank, the container platform may rotate with the beverage container about the central axis of the chiller tank in a first direction. The agitator may rotate the water in a second direction. In some embodiments, the first and the second directions may be opposite directions.

A beverage chiller according to some embodiments may include evaporator coils that extend into the chiller tank and form a cylindrical space inside the chiller tank. Ice may form on the evaporator coils forming ice. The ice may be one inch thick. The thickness of the ice may be measured by an ice probe located in the chiller tank. The beverage chiller may also include an air dryer system. The air dryer system may have one or more air nozzles that direct air over the surface of the beverage container when the beverage container is removed from the chiller tank and returned to the intake area. The air dryer system may blow water off the surface of the beverage container so that the beverage container is dry or mostly dry when it reaches the intake area and is removed by the customer. In some embodiments, filtered air is used in the air dryer system.

According to some embodiments, a beverage chilling system includes a chiller tank and a refrigeration unit. The chiller tank may hold a water bath. The refrigeration unit may include evaporator coils that extend into the chiller tank. The evaporator coils may form a cylindrical space inside the chiller tank. A rotating platform configured to hold a beverage container may rotate inside the cylindrical space inside the chiller tank in a first direction. An agitator in the chiller tank rotates water in the chiller tank in a second direction. In some embodiments, the first and the second direction may be opposite directions. The chiller tank with water bath may include a hollow ice cylinder. The platform may rotate in the interior of this hollow ice cylinder.

A beverage chilling system according to some embodiments may also include a graphical user interface and a product scanner. The product scanner may be configured to determine a characteristic of the container. Some embodiments of a beverage chilling system may have an ultraviolet light extending into the chiller tank.

A beverage chilling system may include a water exchange system. The water exchange system may include a drain to drain water from the chiller tank and a pump to pump water into the chiller tank from a water source. Some beverage chilling systems may use a replaceable container as the water source.

A method of cooling a fluid in a container include forming a hollow ice cylinder inside a water bath. The container may be rotated in a first direction inside the hollow ice cylinder and the water inside the water bath may be rotated in a second direction. In some embodiments, the first and second directions are opposite directions. In some embodiments, the method includes scanning the container to determine a container characteristic. The container characteristic may be used to determine a run time of the method. The run time may relate to the amount of time the container is rotated inside the hollow ice cylinder.

DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1:
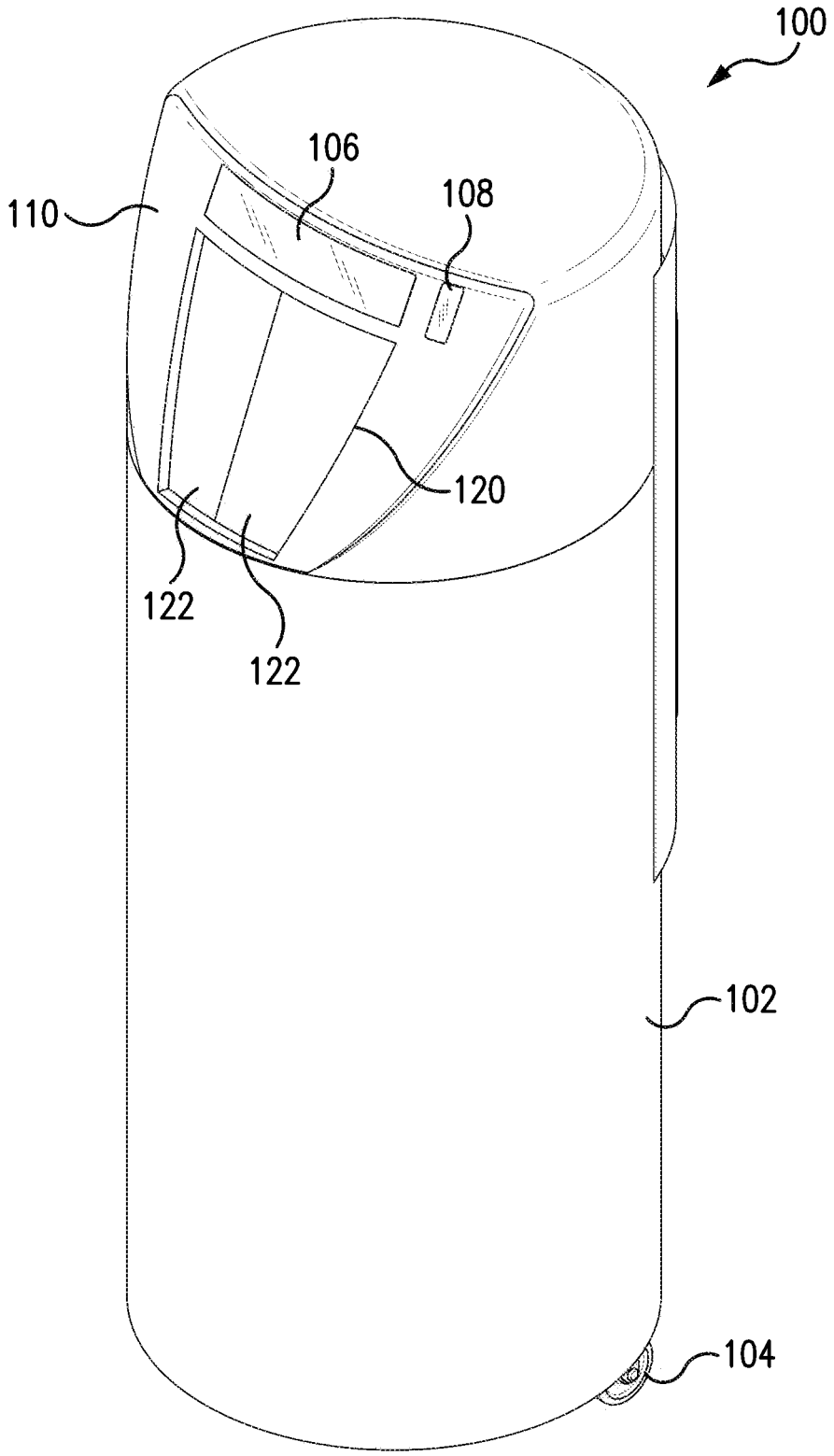
FIG. 1 shows a front perspective view of a beverage chiller according to some embodiments.

Reference will now be made in detail to representative embodiments illustrated in the accompanying drawing. It should be understood that the following descriptions are not intended to limit the embodiments to one preferred embodiment. To the contrary, it is intended to cover alternatives, modifications, and equivalents as can be included within the spirit and scope of the described embodiments as defined by the claims.

Some customers desire chilled beverages. Vendors offering chilled beverages may keep the beverages inside large refrigeration units that keep dozens of beverages inside beverage containers chilled for the consumer. These refrigeration units may lack visual appeal and these units may be less efficient because of the constant cooling requirements. For example, the large refrigeration unit may continue to operate when the store is closed or during periods where customers are selecting beverages in the refrigeration unit less often. Additionally, some beverage customers may not desire the beverage to be cooled in the can. For example, the customer may wish to take the beverage and enjoy it at a later time or may pour the contents over ice.

The present disclosure is directed to a beverage chiller and related methods. The beverage chiller cools a limited number of beverage containers at a time in response to a customer's desire. For example, the beverage chiller may chill one beverage at a time. A customer desiring a chilled beverage may select a beverage from a beverage display having several beverages in beverage containers. For example, the container may be PET bottle, aluminum can, glass, or other types of container. The container may contain a beverage such as, for example, water, soda, alcoholic beverages, wine, or juice.

Once the customer selects the beverage, the customer may place the beverage container on a container platform of the beverage chiller. The container platform and the beverage container may move into a chiller tank. The chiller tank may be filled with water and have ice. The container platform and beverage container may rotate about an axis of the chiller tank such that the beverage container moves in close proximity to the ice. The ice may be formed on evaporator coils. This also gives the ice a shape, such as a hollow cylindrical shape. Simultaneously, the water in the chiller tank may rotates in an opposite direction of the container platform. The rotation of the container platform and beverage container introduces a turbulent flow in the contained beverage. The rotating water also has a turbulent flow. These two turbulent flow exchange heat across the beverage container cooling the beverage. After the cooling process, an air dryer may blow the excess water off the can before the container platform returns the cooled beverage to the customer. The entire process may take only a short period of time so as not to keep the customer waiting. The delivery of the chilled beverage may also be accomplished in an automated manner, such that the user may be required to provide no manual input or limited manual input. This may enhance the overall user experience of purchasing or receiving a beverage.

As with many customer interactive devices, cleanliness is an important component. Beverage coolers according to some embodiments may include one or more systems to ensure the beverage container returned to the customer is clean and attractive. For example, the water in the water bath may be subjected to constant or selectively intermittent ultraviolet light to maintain a sterile water bath. Additionally, the water bath may use only filtered water and additional filters may be placed in the tank to continuously filter the water. Some beverage chillers may require that the water in the chiller tank be replaced regularly such as, for example, after one day of use or a given number of cycle. The old water may be drained and the new water may be introduced from a water tank or a plumbed water supply.

While described as a beverage chiller, the principles employed are not limited only to beverages or beverage containers but could be used in a variety of applications where chilling an item in a container, or an item, is desired. For example, a chiller could be used to cool other items. For example, the chiller could cool food to a low temperature.

These and other embodiments are discussed with reference to the figures, which are incorporated by reference thereto in their entirety. However, those skilled in the art will readily appreciate that the detailed description given herein with respect to these figures is for explanatory purposes only and should not be construed as limiting.

A beverage chiller 100 may have several components. In some embodiments, beverage chiller 100 has a housing body 102 that surrounds the inner components of beverage chiller 100. Housing body 102 may be made of stainless steel, plastic, or other materials. Housing body 102 may be mounted on casters 104 to enable the easy movement of beverage chiller 100.

Figure 2:
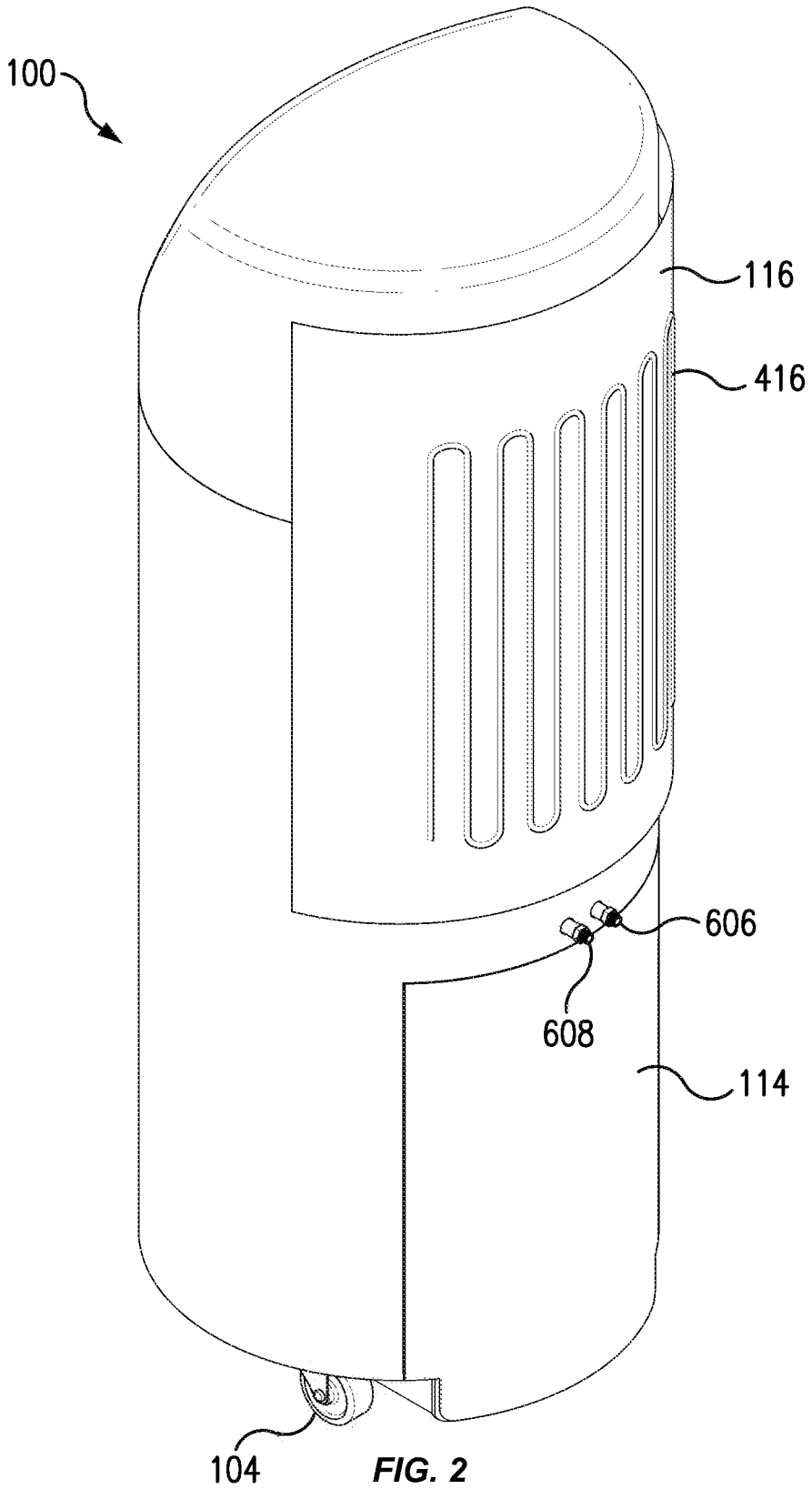
FIG. 2 shows a rear perspective view of the beverage chiller of FIG. 1.

FIG. 2 shows another perspective view of beverage chiller 100 shown in FIG. 1. As shown in FIG. 2, beverage chiller 100 may have additional components on the back. These components may be components that are not used by a customer but are used for maintenance by an operator, such as a shop owner or vendor. For example, the rear of beverage chiller 100 may include an access panel 114. An operator may access internal components of beverage chiller 100 by removing or opening access panel 114. Beverage chiller 100 may also include a drain outlet 606 and a water inlet 608 that couple to a water drain and water supply, as discussed in more detail below.

Housing body 102 may include a front face 110. As shown in FIG. 1, front face 100 may include several components related to customer interaction with beverage chiller 100. For example, front face 110 may include an intake 120, display screen 106, and a scanner 108. Intake 120 may have one or more intake doors 122 that open in response to a customer's prompts. Display screen 106 may be a touch screen that displays prompts to the customer. For example, display screen 106 may include a welcome message such as, for example, "WELCOME," an interactive message such as, for example, "CHILL MY CAN," and a portion having a "START" button graphical displayed. Display screen 106 may also display product information, videos, advertisements, or display the time left in a cooling cycle. Additionally, display screen 106 may prompt the user for additional information before or during the chilling cycle. For example, display screen 106 may prompt a customer for a temperature selection corresponding to how chilled the customer would like their beverage. Display screen 106 may also prompt the customer for rewards information.

Scanner 108 may be an optical scanner configured to read product information from beverage container 10. For example, scanner 108 may read a Universal Product Code ("UPC") printed on beverage container 10. In embodiments, scanner 108 may comprise an RFID reader, a camera, a QR code reader, or other suitable scanner. Scanner 108 may be operatively coupled to a control unit 112 that correlates the scanned product information with a container characteristic. The container characteristic may be the desired temperature the contained beverage should be served at, the material of the beverage container 10, the type of beverage container 10 (for example, an aluminum can or a PET bottle), the volume of beverage in beverage container 10, or the size of beverage container 10. One or more of these factors may be relevant to determining how long beverage container 10 should remain in beverage chiller 100 or what settings should be used to most effectively chill the beverage in beverage container 10. Scanner 108 may also control customer access to beverage chiller 100. For example, if the container information scanned shows a container that is not compatible with, or not permitted in, beverage chiller 100, controller unit 112 may transmit a signal to intake doors 122 instructing them to remain closed. Display screen 106 may display a message indicating that the scanned beverage container 10 is not compatible with beverage chiller 100. Scanner 108 may also be used to scan other codes such as consumer loyalty program barcodes, coupon codes, or digitally rendered codes from a smartphone or other device.

According to some embodiments, once a customer has completed scanning beverage container 10 and making any necessary or optional selections on display screen 106, the customer may place beverage container 10 in an intake 120. Once beverage container 10 is in intake 120, the beverage chilling processing may begin. In embodiments, intake 120 may comprise a cavity formed in housing body 102.

In embodiments, intake 120 has intake doors 122. Intake doors 122 may remain closed except when accepting beverage container 10 to be chilled or when returning beverage container 10 to the customer after chilling. As mentioned above, control unit 112 may be operatively coupled to intake doors 122. In operation, intake doors 122 may be closed by electronics unit 112 after the customer places beverage container 10 on container platform 124 and presses the appropriate commands on display screen 106. In some embodiments, additional sensors may be included in or near intake 120 to check for obstructions or debris inside intake 120 and may stop the chilling processing and alert the customer if any obstruction or debris is found.

Figure 3:
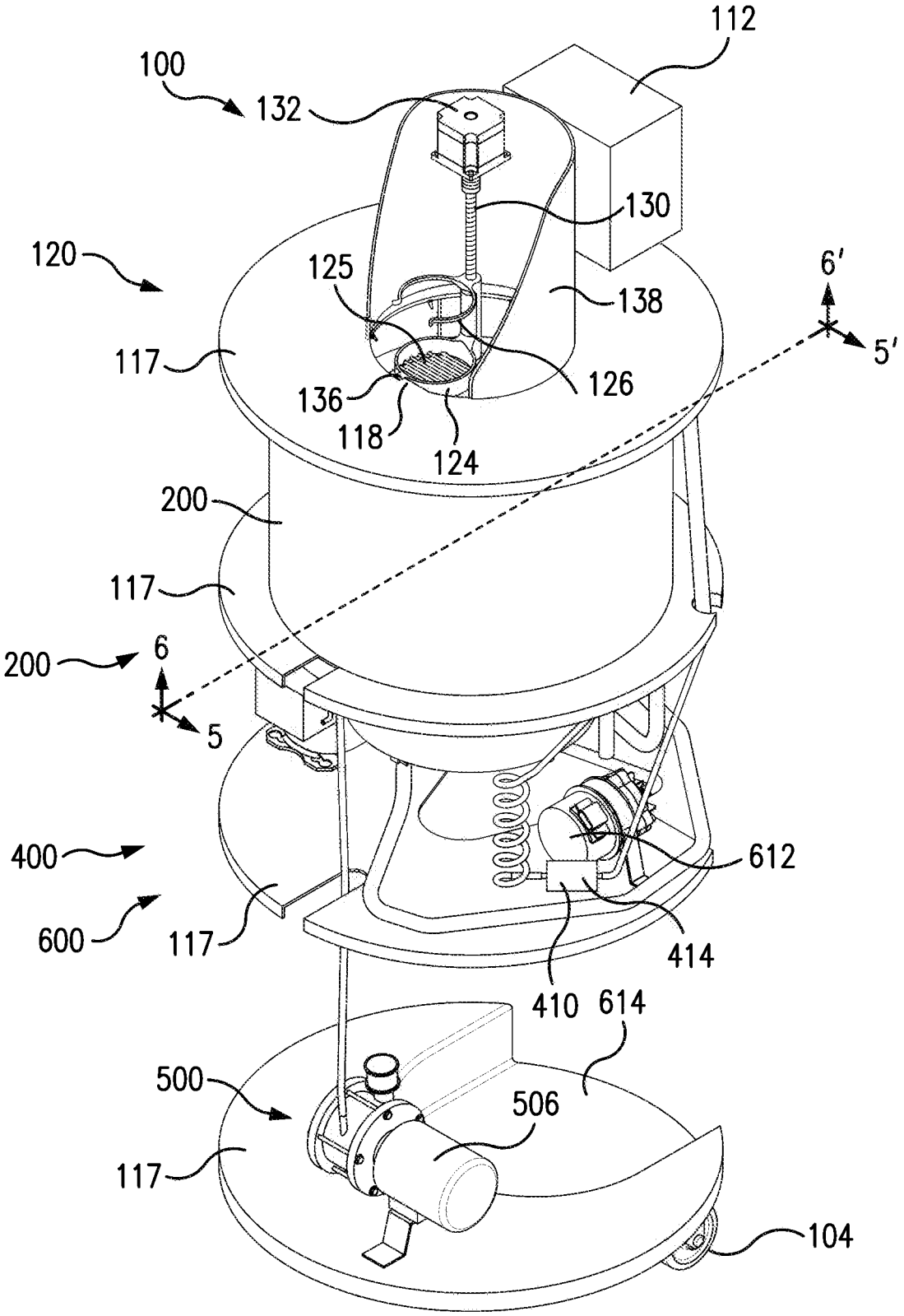
FIG. 3 shows a front perspective view of some components of the beverage chiller of FIG. 1.
Figure 4:
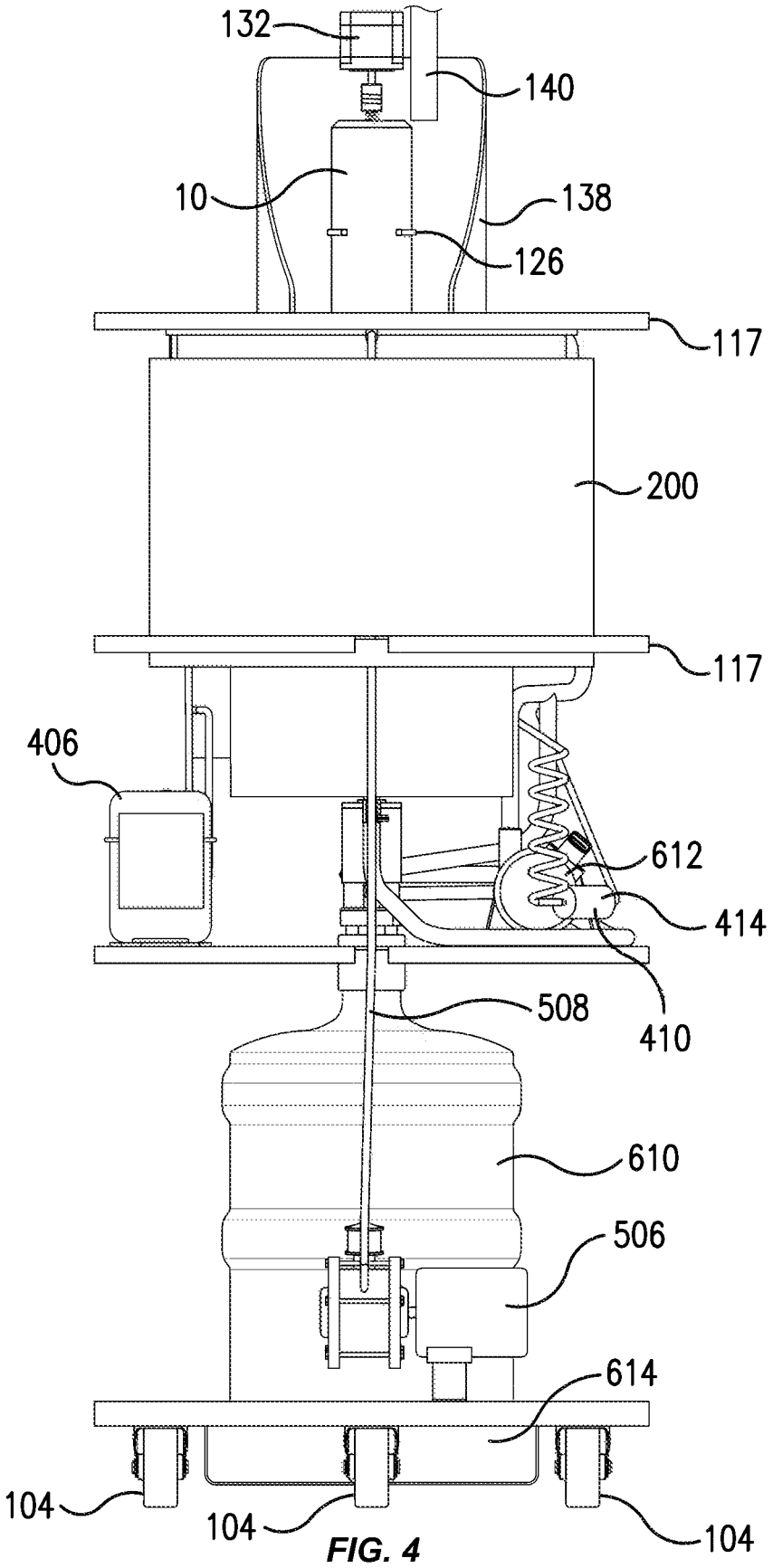
FIG. 4 shows a front view of some components of the beverage chiller of FIG. 1.

FIGS. 3 and 4 shows some components of beverage chiller 100. According to some embodiments, systems of beverage chiller 100 may be broadly grouped into intake 120, chiller tank 200, refrigeration system 400, air system 500, and water system 600. These systems work together and have some common components. FIG. 3 shows some components of each system divided by support platforms 117. Each system of beverage chiller 100 does not operate and is not housed exclusively between two support platforms 117. Components of each system may be between multiple pairs of support platforms 117 and components may cross support platforms 117. However, for clarity, FIG. 3 identifies portions of beverage chiller 100 that have major components of each system. Subsystems of each are also identified.

FIGS. 3 and 4 shows intake 120 at the top of beverage chiller 100. As previously described, intake 120 has intake doors 122 that open in response to a command from control unit 112. When intake doors 122 open, a customer is able to place beverage container 10 on container platform 124. Container platform 124 may have drain holes 125 that prevent water from pooling on container platform 124. One or more container retention members 126 may extend from container platform 124. Container retention members 126 may be biased members such that they securely hold beverage container 10 to container platform 124. Container platform 124 may also have a platform notch 136 that extends from container platform 124. Platform notch 136 may aid in locating container platform 124 after each chilling operation. For example, if beverage container on beverage platform 124 is rotated back to intake 120 after the chilling operation, platform notch 136 may interfere with a support notch 118 to arrest the rotation of beverage platform 124 such that it is properly aligned in intake 120 for the customer to remove beverage container 10 from container platform 124.

Container platform 124 in intake 120 may be partially surrounded by intake shield 138. Intake shield 138 may obscure internal components from customer to present a more visually appeal intake 120. Intake shield 138 also prevents a customer from probing the inside of beverage chiller 100. Also, in some embodiments, container platform 124 may also include a horizontal support member 140 configured to engage a top surface of beverage container 10. Horizontal support member 140 may be configured such that the customer attaches or lowers horizontal support member 140 engage the top surface of beverage container 10. In some embodiments, horizontal support member 140 may be mechanically driven to engage the top surface of beverage container 10 after doors 122 close.

Container platform 124 may be coupled to a container conveyor 130 that moves container platform 124, and beverage container 10 on container platform 124, from intake 120 to a chiller tank 200. Container conveyor 130 has conveyor motor 132 to drive container conveyor 130. In some embodiments, a container conveyor 130 may be a belt assembly, a pulley assembly, an elevator, or other type of movement device. Container conveyor 130 may be, for example, a lead screw. Conveyor motor 132 may rotate lead screw. Container platform 124 may have a drive portion on the lead screw that is driven by the rotation of the lead screw. If, for example, container conveyor 130 is a lead screw, the rotation of the lead screw may move container platform 124 up and down on the lead screw. Additionally, the rotation of the lead screw may cause container platform 124 to rotate. When a lead screw is used, additional components may also be present to control the vertical and rotational movement of beverage container 10 on container platform 124. For example, tabs may be used on the internal surface of the path that container platform 124 takes inside beverage chiller 100. The tabs may engage with platform notch 136. When tabs engage with platform notch 136 while a lead screw is rotated, container platform 124 may move only vertically and may not rotate. When no tab is present, container platform 124 may both rotate and move vertically.

Figure 5:
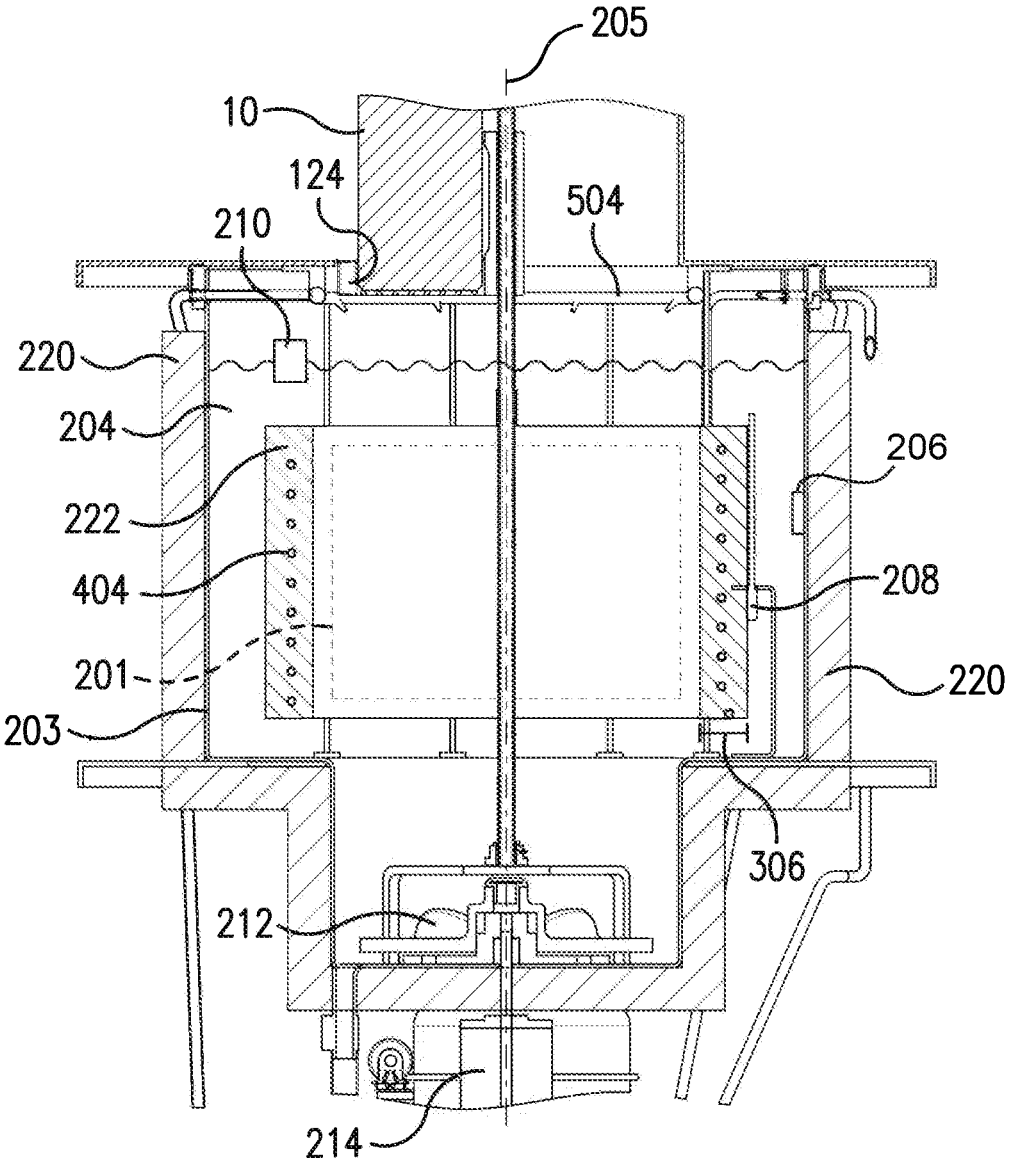
FIG. 5 shows a cross section of some components of the beverage chiller of FIG. 1 taken through the line 5-5' shown in FIG. 3.

Container conveyor 130 moves beverage container 10 on container platform 124 to a central area 201 of chiller tank 200. FIG. 5 shows a cross section of chiller tank 200 according to some embodiments. Chiller tank 200 has a basin 203 to hold a water bath 204. A central area 201 of chiller tank 200 is surrounded by evaporator coils 404. Evaporator coils 404 extend into chiller tank 200 and basin 203 and define central area 201. According to some embodiments, a central axis 205 of chiller tank 200 is collinear with a central axis of central area 201. According to some embodiments, a central axis 205 of chiller tank 200 is defined as the central axis of central area 201. In some embodiments, central axis 205 is defined as the axis around which beverage container 10 on container platform 124 rotates. Chiller tank 200 also has insulation 220 that extends around basin 203. Insulation 220 reduces the rate of heat transfer into the basin 203.

Water bath 204 may fill most or all of basin 203. A level of water in chiller tank 200 may be monitored with a float switch 210 or by other means. When a level of water in chiller tank 200 is too low, water may be pumped into chiller tank 200. Conversely, when a level of water in chiller tank 200 is too high, water may be drained from chiller tank. Basin 203 also includes an agitator 212. Agitator 212 drives water bath 204 in a direction. For example, agitator 212 may drive water bath 204 such that it rotates around central axis 205. According to some embodiments, agitator 212 may be an impeller. Agitator 212 may also be a nozzle or group of nozzles configured to drive water bath 204.

FIG. 5 shows ice 222 surrounding central area 201. Ice 222 may have a hollow cylindrical shape such as that shown in FIG. 5. In some embodiments, ice 222 may have other shapes or configurations. In some embodiments, ice 222 maybe be in the form of an ice ring or an ice portion. In some embodiments, ice 222 forms around evaporator coils 404 extending into basin 203 of chiller tank 200. The shape of evaporator coils 404 in basin 203 may determine the shape of ice 222 in chiller tank 200. For example, evaporator coils 404 may be formed in a cylindrical shape inside chiller tank 200 defining a cylindrical space inside chiller tank 200. Ice 222 formed around evaporator coils 404 may also form and define a cylindrical space inside chiller tank 200.

Ice 222 is formed as water in water bath 204 freezes on evaporator coils 404. The formation of ice 222 can be controlled by changing the rate of heat transfer through refrigeration system 400. In some embodiments, the rate of heat transfer through refrigeration system 400 is controlled so that the evaporator coils 404 are maintained at a temperature below 0° C. In some embodiments, evaporator coils 404 are maintained at a temperature below −22° C.

Increasing the rate of heat transfer may increase an ice thickness 306 and decreasing the rate of heat transfer may decrease the ice thickness 306. In this way, ice thickness 306 may be variable by the operator. Ice thickness 306 may be monitored using an ice thickness probe 208. In some embodiments, ice thickness probe 208 transmits an electrical signal to control unit 112 when submerged in water but stops transmitting when the probe is not in contact with the water, for example when ice 222 had reached a thickness around evaporation coils 202 such that ice 222 contacts ice thickness probe 208. Precise control of the ice thickness 306 is important because if ice thickness 306 is too large, ice 222 may interfere with the movement, including the rotation, of beverage container 10 in chiller tank 200. Additionally, if ice thickness 306 is too thin, the transfer of heat out of beverage container 10 and into water bath 204 may be less efficient.

According to some embodiments, ice thickness 306 may be controlled by control unit 112. Control unit 112 may control ice thickness 306 based on operating conditions or other variables. In some embodiments, ice thickness 306 controlled to maintained a pre-determined thickness. For example, ice thickness 306 may be controlled to be one inch, one half inch, or other thicknesses. Ice thickness probe 208 may be located at a pre-determined distance from evaporator coils 404 to measure ice thickness 306. Ice thickness probe 208 may be movable to other locations in chiller tank 200 to measure ice thickness 306. Ice thickness probe 208 may be movable either manually by the operator or may be movable by control unit 112.

Figure 6:
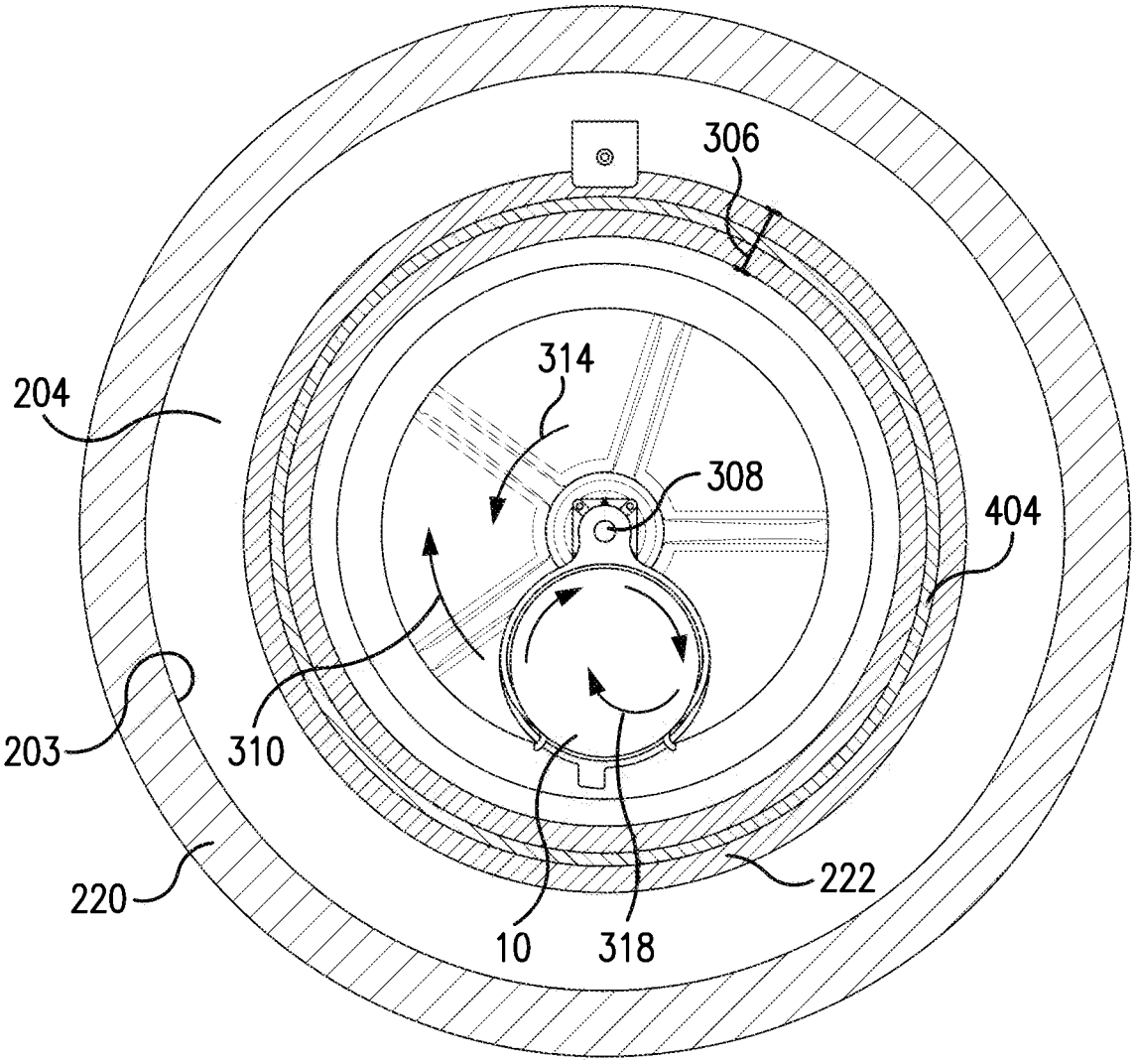
FIG. 6 shows a cross section of some components of the beverage chiller of FIG. 1 taken through the line 6-6' shown in FIG. 3.
Figure 7:
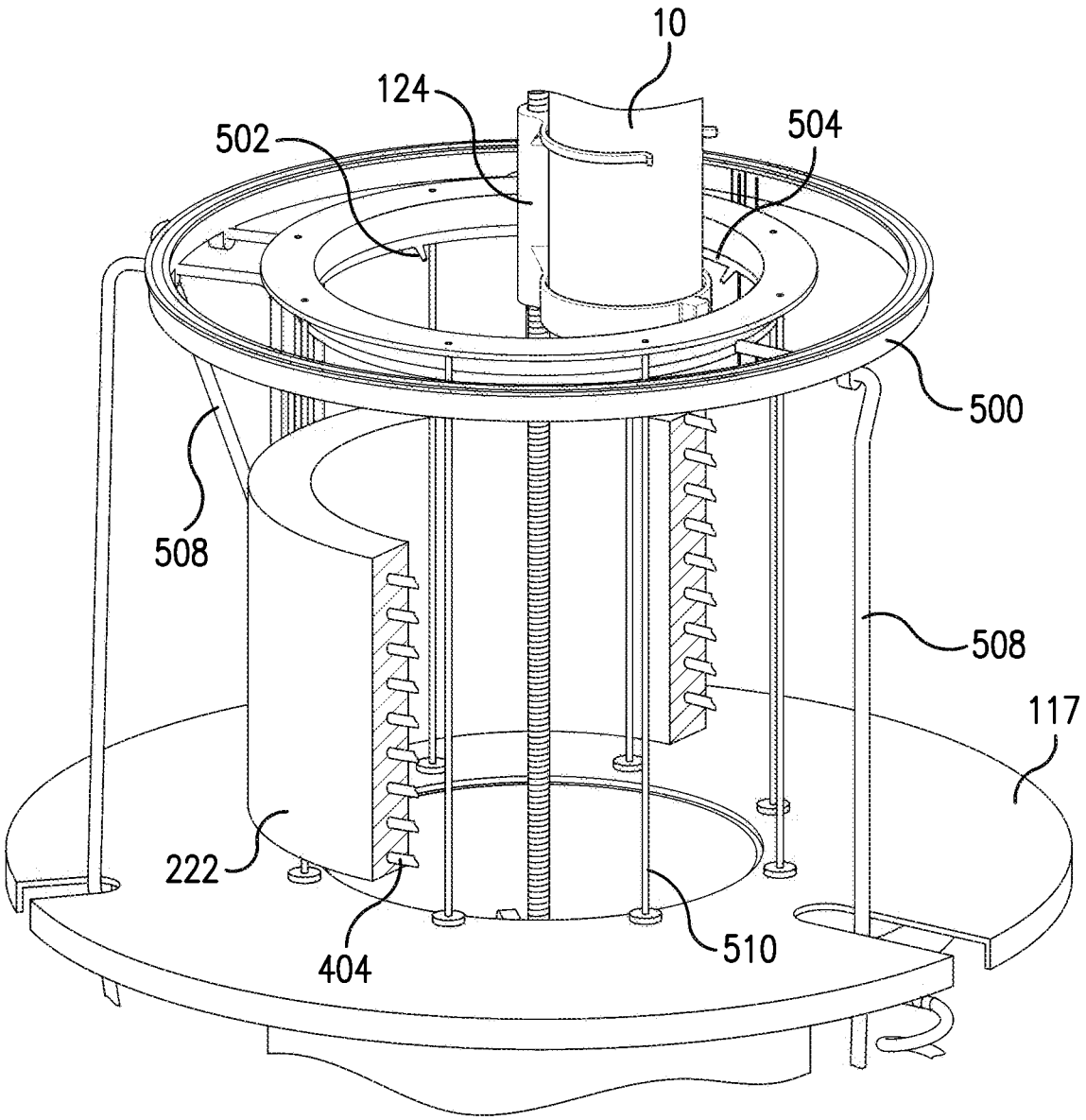
FIG. 7 shows a partial cross section view of a chiller tank according to some embodiments.

In operation, once beverage container 10 on container platform 124 is located in central area 201, the beverage container 10 is rotated rapidly in a first direction 310 around central axis 308. FIG. 6 shows first direction 310 rotated around central axis 308. The According to some embodiments, the rotation of beverage container 10 is controlled by conveyor motor 132. This may be the same conveyor motor 132 used to lower beverage container 10 from intake 120 to chiller tank 200 or it may be a different conveyor motor 132. Use of a lead screw or a drive screw may be particularly useful in these embodiments. For example, rotating the lead screw may cause beverage container 10 on container platform 124 to rotate in chiller tank 200. In some embodiments, container platform 124 may move beverage container 10 up and down, or translate, beverage container 10 in chiller tank 200. Container platform 124 may translate beverage container 10 in chiller tank 200 before, after, or during the cooling cycle.

As beverage container 10 on container platform 124 rotates in first direction 310, the beverage contained in beverage container 10 rotates in a liquid rotation direction 318. This is caused by the centripetal forces acting on the beverage contained in beverage container 10 as it rotates in first direction 310. Agitator 212 driven by agitator motor 214 induces water bath 204 to rotate in a second direction 314. In some embodiments, first direction 310 and second direction 314 are opposite directions.

Rotating water bath 204 and beverage container 10 in opposite directions increases the rate of heat transfer between the contained beverage and water bath 204. The contained beverage has a turbulent flow profile and creates a vortex like flow inside beverage container 10. This flow profile maximizes the rate of the heat transfer inside the beverage. Further, moving beverage container 10 through water bath 204 in a direction opposite of the direction water bath 204 is moving, a large volume of cool water is passing over the exterior of beverage container 10 to absorb heat from the contained beverage.

The nearer beverage container 10 rotates to ice 222 the more rapidly heat may be transferred from beverage container 10 to water bath 204. However, as mentioned above, beverage container 10 should not rotate so close to ice 222 to risk hitting or otherwise inferring with ice 222. The amount of time that beverage container 10 rotates in chiller tank 200 is controlled by control unit 112. he amount of time may be based on a customer input. For example, the customer may select "VERY CHILLED" to indicate a beverage they desire to be chilled to a temperature close to 2° Celsius. Alternatively, the customer may select "LITE CHILL" for a temperature closer to 5° Celsius.

According to some embodiments, the amount of time may be based on information determined from scanner 108. For example, when customer scans beverage container 10, control unit 112 may determine the beverage product contained in beverage container 10 either by reference to a look-up or over a network. The beverage product may have an associated beverage characteristic that control unit 112 relates to a run time. For example, the beverage characteristic may be a target temperature for the beverage contained in beverage container 10. Thus, for example, the beverage may be best enjoyed at a temperate of 8° Celsius so the run time may be set at 30 seconds. Or, for example, the beverage may be best enjoyed at a temperate of 2° Celsius so the run time may be set at 40 seconds. According to some embodiments, the target temperature may be the same for all beverages, for example 3.2° Celsius. The run time may be the amount of time that beverage container 10 is submerged in water bath 204. Run time may also be the amount of time that beverage container 10 is rotated in water bath 204.

The beverage characteristic may also be used to validate that beverage container 10 is compatible with beverage chiller 100. For example, the beverage characteristic may be a brand or product identifier or may be the size of beverage container 10. Validation may ensure that only recognized or branded products are used with beverage chiller 100. This can increase the exclusivity of the beverage chiller 100's customer experience and gives the vendor greater quality control assurances because only known products will be chilled.

After the chilling cycle completes, container conveyor 130 moves beverage container 10 on container platform 124 back to intake 120. According to some embodiments, as beverage container 10 moves towards intake 120, an air system 500 removes excess water from the surface of beverage container 10. Thus, once beverage container 10 reaches intake 120, beverage container 10 is dry when the customer removes it from beverage chiller 100.

According to some embodiments, when container conveyor 130 moves beverage container 10 on container platform 124 back to intake 120, an air system removes water and moisture from the surface of beverage container 10. In some embodiments, air system removes water and moisture as beverage container 10 exits water bath 204. In some embodiments, air system 500 does not engage until after beverage container 10 is removed from water bath.

In some embodiments, the air system 500 has an air supply 506 that pressurizes air. In some embodiments, the air may be filtered by air supply 506. Pressurized air moves through air tubing 508 to air nozzles 502. Air nozzles may be mounted to air nozzle system 504. Pressurized air may pass through air nozzle system 504 before it is expelled through air nozzles 502. The air nozzle system may be supported by air unit supports 510. Air unit supports 510 locate air nozzles 502 between chiller tank 200 and intake 120.

Air nozzles 502 may be biased towards the water bath such that the flow of air across beverage container 10 is generally downward. This reduces the splashing of water and pushes the water down beverage container 10 when it is withdrawn from water bath 204. Water also exits through drain holes 125 on the bottom of container platform 124. Drain holes 125 prevent the pooling of water in or on container platform 124.

In addition to removing liquid from the exterior of beverage container 10, air nozzles 502 also help clean beverage container 10 by using purified air. Other components and systems of beverage chiller 100 contribute to the cleanliness of beverage chiller 100. These systems may be both procedural, such as requirements that the water in chiller tank 200 be changed regularly, or structural, such as ultraviolet light inside chiller tank 200 to continuously disinfect water. For example, chiller tank 200 according to some embodiments includes ultraviolet light 206 that continuously sterilizes water bath 204.

Beverage chiller 100 uses water supplied by water system 600. Water system 600 controls the flow of water into and out of beverage chiller 100. Water system 600 may have a water pump 612. Water pump 612 pumps water from a water source to chiller tank 200. Water source may be either water tank 610 or an external water supply such as, for example, a municipal water suppler. Water system 600 may be connected to an external water supply by a water inlet 608. Drain outlet 606 may be near water inlet 608. Water can be drained through drain outlet 606 into a municipal drain system or the like.

In some embodiments, water pump 612 pumps water from a water tank 610. Water tank 610 may be removable by the beverage chiller 100 operator. Water tank 610 may have purified water to help ensure a clean operating environment inside beverage chiller 100. Water tank 610 may also be used to collect water that is drained from chiller tank 200. For example, water pump 612 may pump water into an empty chiller tank 200. Once the water needs to be replaced, the water can be drained back into water tank 610. Water tank 610 with the used water is removed by the vendor and replaced with a fresh water tank 610. Water tank 610 may be located on a tank shelf 614 configured to receive water tank 610.

Control unit 112 may include a logic controller that determines the number of times beverage chiller 100's current water bath has been used. The logic controller may require that the water in chiller tank 200 be changed regularly or after a certain number of cycles. For example, logic controller may require that the water be changed daily or after every 50 cycles.

When beverage chiller 100 is plumbed to an external water supply such as a municipal water supply, water may be pumped in and drained from beverage chiller 100 using switches. For example, water may be pumped into beverage chiller 100 when a refill switch 604 is pressed. Water may be drained from beverage chiller 100 when a drain switch 602 is pressed. In some embodiments, drain switch 602 and refill switch 604 may be accessed on the exterior of beverage chiller 100 to facilitate easy access for the vendor. In some embodiments, the draining and refilling may be automated. The draining and refilling may also be tracked for quality controller purposes and reported to a centralized source such as a server.

With the possible exception of the replacement of water for water bath 204, beverage chiller 100 may be a self-contained apparatus according to some embodiments. For example, beverage chiller 100 may include refrigeration system 400. In some embodiments, refrigeration system 400 has an evaporator 402, compressor 406, condenser 408, and expansive valve 410. Portions of refrigeration system 400 are fluidly connected by coolant tubing 412. Refrigeration system 400 may also include a dryer 414 to condition the coolant. Condenser coils 416 may extend to the back surface of beverage chiller 100 to reject heat from beverage chiller 100. Condenser coils 416 may be mounted on a condenser coil mount 116 which may keep condenser coils 416 separate from housing body 102 to promote more efficient heat transfer.

Figure 8:
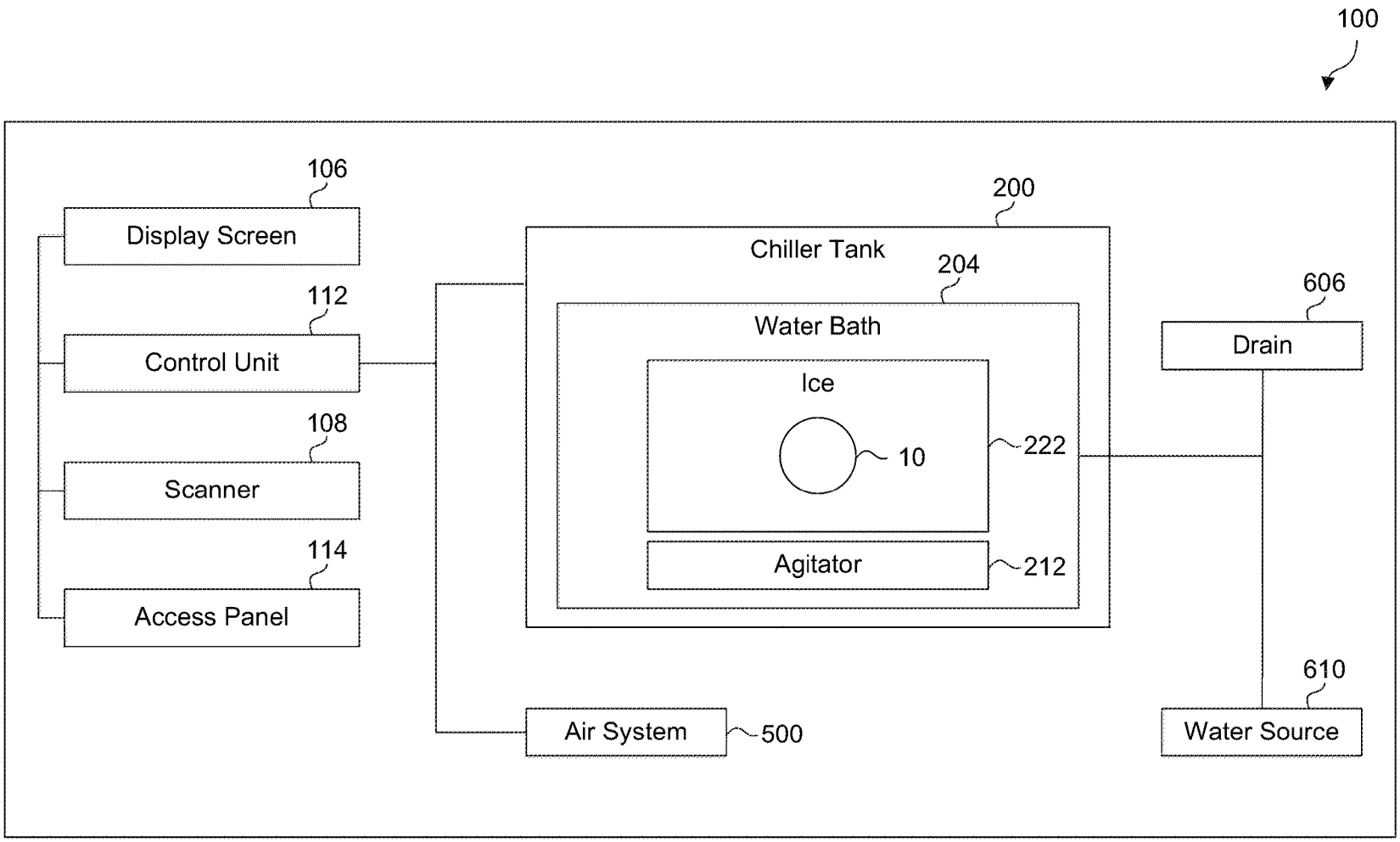
FIG. 8 shows a block diagram of the components of a chiller tank according to some embodiments.

FIG. 8 shows a schematic diagram of the components of beverage chiller 100 according to some embodiments. In some embodiments, beverage chiller 100 has control unit 112 operatively coupled to display screen 106, scanner 108, and access panel 114. Control unit 112 is also operatively coupled to chiller tank 200 and air system 500. Air system 500 may be operatively coupled to chiller tank 200 such that air system 500 may remove moisture from beverage container 10 when it is withdrawn from chiller tank 200.

As shown in FIG. 8, chiller tank 200 includes water bath 204. Ice 222 may be formed in water bath 204. As described above, ice 222 may be formed about evaporator coils 404. In some embodiments, agitator 212 is also located in water bath 204. Water bath 204 may be operatively coupled to water source 610 and drain 606. Water may be pumped into chiller tank 200 from water source 610 and removed from chiller tank 200 with drain 606.

It is to be appreciated that the Detailed Description section, and not the Summary and Abstract sections, is intended to be used to interpret the claims. The Summary and Abstract sections may set forth one or more but not all exemplary embodiments of the present invention as contemplated by the inventor(s), and thus, are not intended to limit the present invention and the appended claims in any way.

The present invention has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments reveal the general nature of the invention so that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments, but should be defined only in accordance with the following claims and their equivalents.

What is claimed is:

1. A method of cooling a fluid in a container, the method comprising:

receiving the container at a container platform;

rotating the container platform to move the container from an intake area to a water bath;

rotating the container in a first direction inside the water bath; and rotating the water in the water bath in a second direction.

2. The method of claim 1, wherein the first and the second directions are opposite directions.

3. The method of claim 1, further comprising;

scanning the container to determine a container characteristic; and determining a run time based on the container characteristic.

4. The method of claim 3, wherein the container characteristic comprises a targeted temperature for the fluid in the container.

5. The method of claim 3, wherein the run time is the amount of time that the container is rotated in the water bath.

6. The method of claim 3, wherein the run time is the amount of time that the container is submerged in the water bath.

7. The method of claim 3, further comprising validating that the container is compatible based on the container characteristic.

8. The method of claim 1, wherein the water bath is held within a chiller tank, the chiller tank comprising a central axis, and wherein the container platform is rotated about the central axis of the chiller tank.

9. The method of claim 1, further comprising rotating the container platform to move the container back to the intake area.

10. The method of claim 9, further comprising removing water and moisture from the surface of the container while moving the container back to the intake area.

11. The method of claim 10, wherein the water and moisture is removed from the surface of the container by pressurized air.

12. The method of claim 1, further comprising forming a hollow ice cylinder inside the water bath.

13. A method of cooling a fluid in a container, the method comprising:

receiving the container at an intake area;

conveying the container from the intake area vertically into a water bath;

rotating the container through the water bath in a direction opposite of the direction the water bath is moving to cool the fluid in the container;

conveying the container from the water bath to the intake area; and drying the surface of the container as the container is conveyed from the water bath to the intake area.

14. The method of claim 13, wherein the water bath is moved by an agitator.

15. The method of claim 13, further comprising forming a hollow ice cylinder inside the water bath.

16. The method of claim 15, wherein the container is rotated within the hollow ice cylinder.

17. The method of claim 15, further comprising controlling a thickness of the hollow ice cylinder by controlling a rate of heat transfer from an evaporator coil.

18. The method of claim 13, further comprising;

scanning the container to determine a container characteristic; and determining a run time based on the container characteristic.

19. The method of claim 13, wherein the water bath is held within a chiller tank, the chiller tank comprising a central axis, and wherein the container is rotated about the central axis of the chiller tank.

20. The method of claim 13, wherein the surface of the container is dried by pressurized air.

* * * * *